US008596927B2

(12) United States Patent
Thomson

(10) Patent No.: US 8,596,927 B2
(45) **Date of Patent: *Dec. 3, 2013**

(54) TIE LINKING FILLED SANDBAGS AND USE IN A BARRIER FORMED FROM FILLED SANDBAGS

(75) Inventor: Ian Robert Thomson, St Neots Cambridgeshire (GB)

(73) Assignee: Saratoga Technologies Limited (GB)

( * ) Notice: Subject to any disclaimer, the term of this patent is extended or adjusted under 35 U.S.C. 154(b) by 0 days.

This patent is subject to a terminal disclaimer.

(21) Appl. No.: 13/053,412

(22) Filed: Mar. 22, 2011

(65) Prior Publication Data

US 2012/0167520 A1 Jul. 5, 2012

Related U.S. Application Data

(62) Division of application No. 11/576,466, filed as application No. PCT/GB2005/050165 on Sep. 28, 2005, now Pat. No. 7,922,426.

(30) Foreign Application Priority Data

Oct. 2, 2004 (GB) ..... 0421866.5

(51) Int. Cl.
*E04B 1/38* (2006.01)

(52) U.S. Cl.
USPC ..... 405/284; 52/715; 52/489.2

(58) Field of Classification Search
USPC ..... 405/284, 302.4, 302.6, 302.7; 52/715, 52/642, 633, 489.2
See application file for complete search history.

(56) References Cited

U.S. PATENT DOCUMENTS

| | | | | |
|---|---|---|---|---|
| 3,922,832 | A | 12/1975 | Dicker | |
| 4,486,115 | A | 12/1984 | Rionda et al. | |
| 4,779,393 | A | 10/1988 | Jong | |
| 5,934,027 | A | 8/1999 | Khalili et al. | |
| 7,922,426 | B2 * | 4/2011 | Thomson | 405/284 |

FOREIGN PATENT DOCUMENTS

| | | | |
|---|---|---|---|
| DE | 8702655 | U1 | 6/1987 |
| DE | 10246582 | | 4/2004 |
| GB | 2259528 | | 3/1993 |
| GB | 2326428 | A | 12/1998 |
| WO | 0061880 | | 10/2000 |
| WO | WO 0061880 | A1 * | 10/2000 |

* cited by examiner

*Primary Examiner* — Benjamin Fiorello
(74) *Attorney, Agent, or Firm* — Brooks Kushman P.C.

(57) ABSTRACT

Barriers for flood defense and other purposes are often constructed using sand bags. The strength of these barriers is limited and the invention seeks to address this problem. The invention provides a tie formed as a single injection moulded item placed between layers of sandbags to help to hold them together. The tie has two rigid triangular end plates (4) and (5) linked by a flexible arm (11). The end plates are formed with protruding spikes (6) shaped with a barb so that they will easily penetrate the fabric of a sandbag but are difficult to pull out. In use, each tie is placed between layers of sandbags so that spikes of respective plates (4) and (5) become anchored to adjoining bags. The bags of the barrier are thus held together and any irregularities in it are accommodated by the flexibility of the arm (11). Slots (14) and lugs (15) allow a plurality of ties to be linked together as may be required when oversize sandbags are employed.

4 Claims, 3 Drawing Sheets

TIE LINKING FILLED SANDBAGS AND USE IN A BARRIER FORMED FROM FILLED SANDBAGS

CROSS-REFERENCE TO RELATED APPLICATIONS

This application is a division of U.S. application Ser. No. 11/576,466 filed Jun. 28, 2007, now U.S. Pat. No. 7,922,426, which is a 371 of International PCT/GB2005/050165, filed on Sep. 28, 2005, which corresponds to GB 0421866.5 filed on Oct. 2, 2003. The disclosures of which are incorporated in their entirety by reference herein.

TECHNICAL FIELD

This invention relates to the construction of walls and barriers, particularly from bags or sacks filled with sand or other particulate material. Such barriers are highly effective for emergency flood defence operations, in military environments for protection against enemy gunfire, for containing the effects of controlled explosions, to protect spectators in motor-sport events and for many other purposes.

SUMMARY

The bags are normally made from woven material such as hessian or synthetic plastics and are filled with sand or any other granular material that can be obtained locally, where the barrier is to be constructed. Sometimes bags are filled with a sand/cement mixture for the construction of underwater barriers. This invention has a potential to be useful in any of the above environments.

Barriers constructed from filled bags can be very effective and quickly constructed. However, being formed from separate units, not connected together, the strength of the barrier is limited. Even bags filled with a sand/cement mixture for underwater use suffer from this weakness and can collapse before the cement has set. The invention was made when considering how the length of these barriers could be improved whilst still retaining the benefit of speed of construction.

It has been proposed, in patent specification U.S. Pat. No. 5,934,027, to use barbed wire between layers of sandbags to stabilise the structure but this technique, whilst helpful, is of limited effectiveness because the barbed wire does not grip well onto the bags.

Furthermore, barbed wire is difficult to handle and is so flexible in all directions that it fails to give sufficient support for many situations.

Another proposal, described in patent specification WO 00/61880 involves the use of spiked plates between the sandbags. This technique could be effective in situations where the ground is perfectly flat and the filled bags can all be guaranteed to be of equal size and shape. However the plates described in that specification would be effective only in situations where adjacent bags lie in truly regular and uniform lines.

Another proposal for solving the problem is described in patent specification DE 10246582 which describes an arrangement in which strands are attached to the bags and tied together to help to prevent the bags from separating. This technique could be some assistance. However, connecting the strands together would waste valuable time in an emergency situation. Also, inevitable slackness of the strands would allow initial displacement of the bags without restraint, until the strands have become taught. Another disadvantage is that specially made bags are needed.

Yet another previous attempt to address the problem is described in patent specification GB2326428 which describes a system in which straps are wrapped around an entire wall of sandbags and drawn tight to hold them together. This technique would appear to be applicable only to special bags which have a defined rectilinear shape and where the intention is to construct a permanent or semipermanent structure in a non-emergency situation.

According to a first aspect of this invention there is provided a barrier formed from filled bags stacked one on top of another and ties having pointed projections for holding the bags together to strengthen the barrier; characterised in that the ties have relatively rigid, spiked, bag-retention members arranged to engage respective sandbags and a relatively flexible connector joining the spiked retention members.

The invention thus can be used to give the benefits of a device like that described in patent specification WO 00/61880 whilst allowing the flexibility required to accommodate imperfect regularity of alignment of the sandbags.

Each tie preferably has spikes facing both up and down and is best positioned so that it bridges adjoining bags. When other bags have been placed on top of it, the weight of the bags presses the spikes through the fabric.

In an alternative construction, the ties are permanently attached to, or are integrally formed with, the bags. For example, panels or strips, formed with appropriate spikes, could be permanently attached by stitching, stapling or adhesive to the bags. However this variation is not preferred because it requires special-purpose bags.

To obtain the required degree of flexibility, the tie preferably takes the form of two spiked panels or plates joined by a relatively thin and therefore flexible stem. Thus, according to a second aspect of the invention there is provided a tie for reinforcing a barrier formed from stacked building units (eg filled bags) characterised in that the tie comprises two plates joined by a flexible connector, each plate having projections extending from opposite faces.

Expressed a different way the invention provides a tie for linking individual building units forming a wall or barrier and characterised in that the tie has two relatively broad and rigid end parts carrying spikes for anchoring into adjacent building material; and a relatively narrow and flexible connector that joins the end parts.

The panels or plates and linking connector can all be defined by a single moulded product of synthetic plastics material though it would be possible to use metal, or a combination of different materials. For example, an effective alternative construction could be made from metal spiked plates crimped onto opposite ends of a short length of nylon cord.

The spikes are preferably barbed so that removal from the fabric of a sand bag is more difficult than penetration. An appropriate barb can easily be formed as part of a moulding process if the tie is made from synthetic plastics material.

There are sometimes situations where larger than normal sandbags are used and where a tie of standard size would not be appropriate. For this reason, the tie is preferably designed so that it an can easily be attached to a similar tie so as to extend its length and/or breadth. In this way it becomes possible to connect together a large number of ties to form a line or network of connectors between the sandbags.

Thus, according to yet another aspect of this invention there is provided a tie for linking individual building units forming a wall or barrier, the tie defining spikes for anchoring into adjacent material of the wall or barrier characterised in that the tie is designed to interlink with adjoining similar ties to form a larger tie.

BRIEF DESCRIPTION OF THE DRAWINGS

An example of one way of implementing the invention will now be described by way of example with reference to the accompanying drawings in which.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
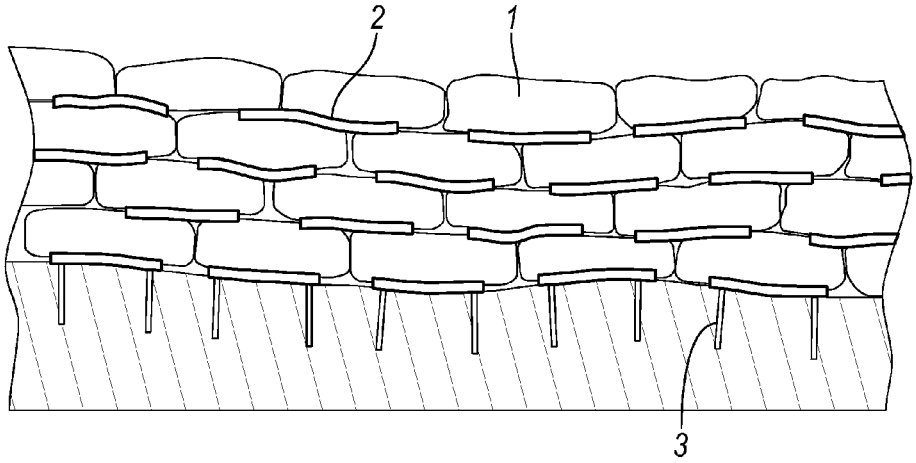
FIG. 1 shows a vertical longitudinal cross-section through a flood barrier formed from sand-bags arranged in layers, reinforced with ties constructed in accordance with the invention.

Referring firstly to FIG. 1, the illustrated barrier is built from sandbags 1 of woven material filled with sand; as is conventional for emergency flood defence purposes. During construction, a layer of ties 2 (to be described later) is placed on the ground and these are pegged into position using steel spikes 3. Bags 1 are then laid, one over each tie, as shown. After laying each layer of bags, ties 2 are placed so that each one bridges across two adjacent bags beneath it.

Figure 2:
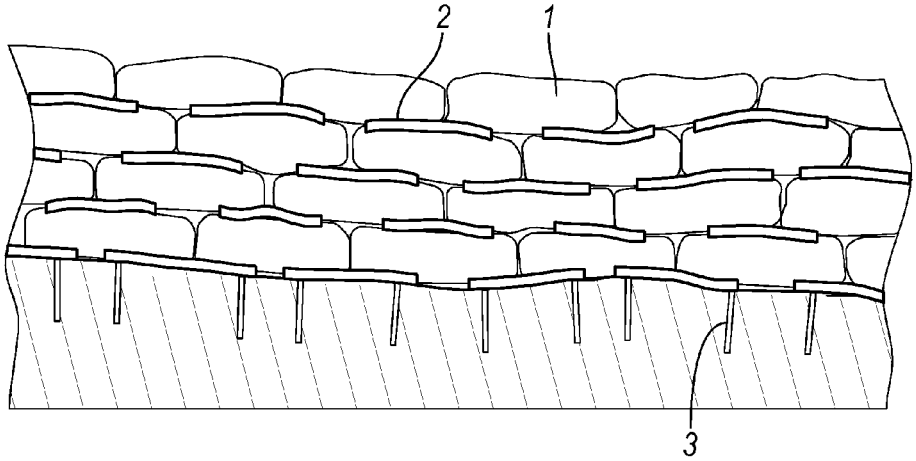
FIG. 2 is similar to FIG. 1 but shows the ties positioned in a different configuration.

In an alternative arrangement shown in FIG. 2, one tie is placed on top of each bag so that it bridges across a pair of overlying bags. The end effect is exactly the same.

Figure 3:
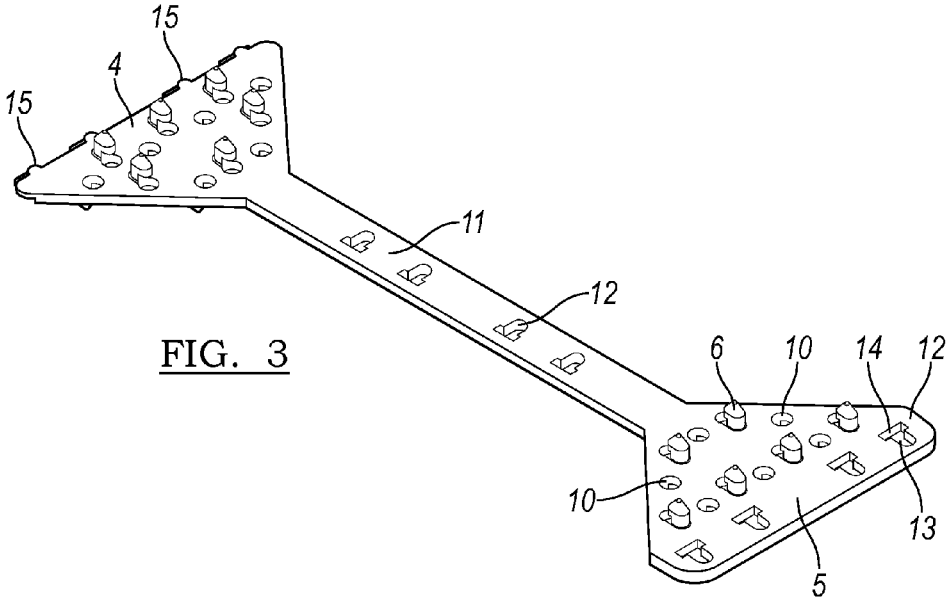
FIG. 3 shows a perspective view of one of the ties as seen from above.
Figure 4:
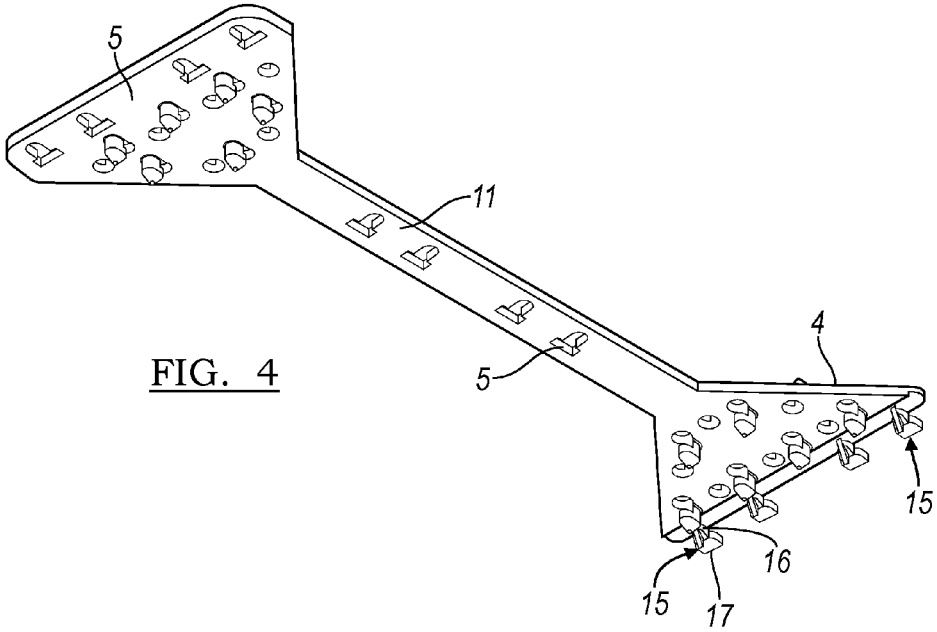
FIG. 4 is similar to FIG. 3 but shows the tie from below.
Figure 5:
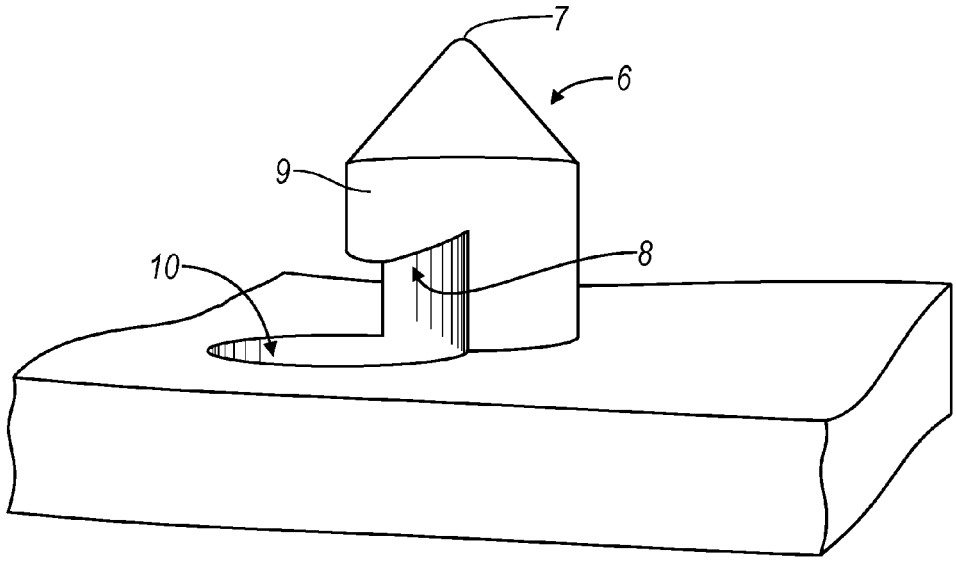
FIG. 5 shows a detailed perspective view of one of the spikes of the tie.

Referring now to FIGS. 3 and 4, each tie 2 is injection moulded as a single piece of recycled synthetic plastics material. It has two rigid triangular end plates 4 and 5. Each plate has an array of spikes 6 projecting from both surfaces, each spike having an elliptical cross-section, the major axis of the ellipse being aligned with the linear 15 axis of the tie. One of these spikes is shown in detail in FIG. 5 which shows its sharp pointed end 7 designed to penetrate the woven fabric of the sacks 1. A recess 8 is formed in each spike. This recess faces towards the centre of the tie and is undercut so as to define a barb 9 that securely retains the spike in the weave of the sack after it has penetrated. The recess 8 is created during the moulding process by a rod on a 20 lower mould plate and this rod also creates holes 10. The holes 10 are used to receive the ground ties 3.

Joining the end plates 4 and 5 is a flexible stem 11. Although relatively narrow (about 22 rams wide) as compared with the plates, this stem has been shown to be capable of withstanding a strain of over one ton whilst having significant flexibility, allowing the tie to conform with the irregular interface between layers of sandbags as shown on FIGS. 1 and 2.

Figure 6:
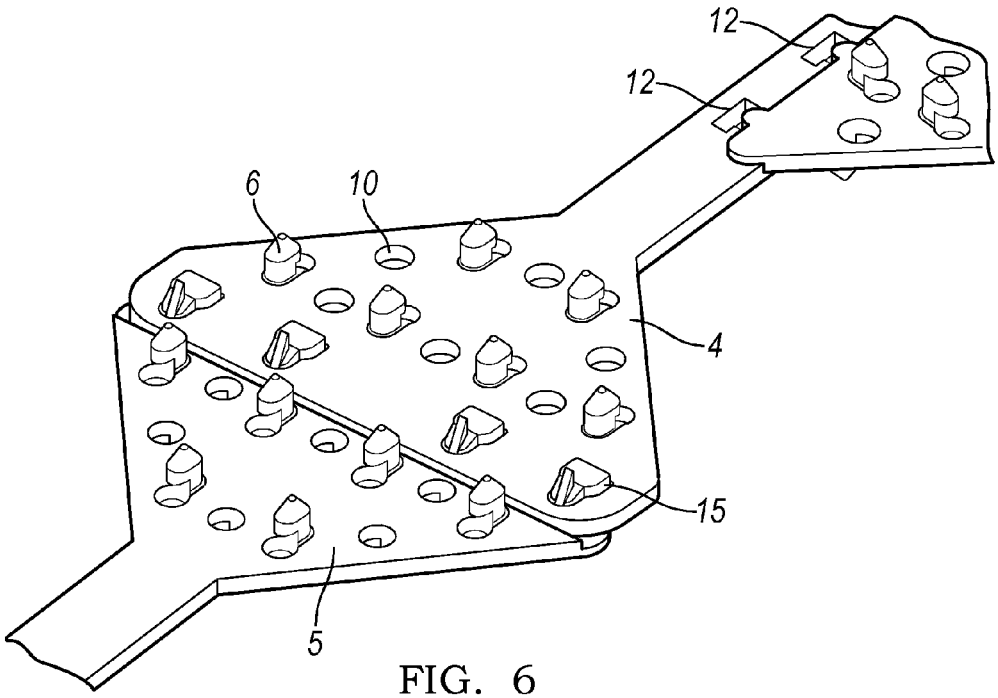
FIG. 6 shows how identical ties can be connected together.

The triangular plate 4 is provided with slots 12 each of which has a narrow part 13 and a wide part 14. The plate 5 has complementary lugs 15 best seen in FIG. 4, each having a narrow part 16 and a wide part 17. By tilting one tie relative to another identical tie it is possible to insert the wide parts of the lugs into the wide parts of the slots. By pulling the ties in a direction away from each other the narrow parts of the lugs will then lock into the narrow parts of the slots to form an oversize tie for use with large sandbags as shown in FIG. 6. Slots 12 are also provided in the stem 11 so that ties (shown broken away on FIG. 6) can be connected at right angles to each other.

In a simple test, where a wheeled digger was used to push against a conventional wail of sandbags, the wall immediately collapsed. In an exactly similar test where the wall had been fitted with ties like that shown in FIG. 2, the wall remained intact, causing the digger wheels to spin without effect.

Of course, the triangular shape of the plates 3 could be replaced by any other convenient shape and it will readily be apparent that many other design variations are possible within the scope of the accompanying claims. Also, there are many variations in the method of use of the tie constructed in accordance with the invention. For example, one end could be permanently built into a permanent wall structure, with the other end protruding so that it is available to tie into any subsequently built extension. Such extension may be temporary and built from sandbags; or may be permanently constructed from masonry materials. The tie according to the invention could also be used in a manner similar to a conventional brick tie, its flexibility allowing accommodation of variation of levels of different layers of bricks or blocks.

Whatever variations of design and use are employed, it is believed that the invention will in a simple, convenient and inexpensive way, allow a significant increase the strength of barriers to be achieved. In sandbag structures it will also allow the use of fewer bags, thus reducing logistical problems, storage requirements and costs. By reducing the number of bags, a critical assembly time advantage can be obtained in those situations where a sandbag structure is needed in an emergency such as for flood defence.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A flexible tie for reinforcing a barrier formed from stacked building units wherein the tie comprises a pair spaced apart plates generally oriented within the same plane linked by a connector interconnecting the plates and unitarily formed and centrally aligned therewith, each plate has barbed projections extending from opposite faces, and the connector comprises an elongate relatively narrow flexible connector strap spanning between the pair of spaced apart plates, the connector strap being more flexible than the plates to enable limited vertical deflection of a central section of the connector strap;

wherein one of the rigid plates is provided with a series of slots and the other one of the rigid plates is provided with a plurality of lugs designed to interlink with the slots of an adjoining similar tie within one plane to form a larger tie assembley; and wherein the central section of the connector strap is provided with a plurality of slots sized to cooperate with the lugs of a rigid plate of a similarly shaped flexible tie oriented at a right angle.

2. A flexible tie for reinforcing a barrier formed of horizontal rows of stacked sand bags, the flexible tie comprising:

a pair of spaced apart relatively rigid plates, each having an upper and lower face each provided with a plurality of barbed projections extending therefrom; and an elongate relatively narrow flexible connector strap spanning between the pair of spaced apart plates, the connector strap being more flexible than the plates to enable limited vertical deflection of a central section of the connector strap;

wherein one of the rigid plates is provided with a series of slots and the other one of the rigid plates is provided with a plurality of lugs designed to interlink with the slots of an adjoining similar tie within one plane to form a larger tie assembley;

wherein the central section of the connector strap is provided with a plurality of slots sized to cooperate with the lugs of a rigid plate of a similarly shaped flexible tie oriented at a right angle; and wherein the ties can be interposed between adjacent rows of sand bags with one face of the flexible tie cooperating with the flexible connector spanning between two adjacent sandbags while the other face of the flexible tie cooperates with a single sandbag in order to limit shifting of the barrier when loaded.

3. The flexible tie according to claim 2 wherein the flexible tie is integrally molded from synthetic plastic material.

4. The flexible tie according to claim 2 wherein the pair of spaced apart relatively rigid plates and the flexible connector are integrally formed as one piece.

* * * * *